US005524759A

United States Patent [19]

Herzberg et al.

[11] Patent Number: 5,524,759

[45] Date of Patent: Jun. 11, 1996

[54] FACIAL TISSUE POCKET PACK

[75] Inventors: John L. Herzberg, Neenah; Thomas W. Cerull, Appleton; Anne L. Miller, Appleton, all of Wis.

[73] Assignee: Kimberly-Clark Corporation, Neenah, Wis.

[21] Appl. No.: 417,717

[22] Filed: Apr. 6, 1995

Related U.S. Application Data

[63] Continuation of Ser. No. 5,712, Jan. 19, 1993, abandoned.

[51] Int. Cl.[6] ..... B65D 73/00

[52] U.S. Cl. ..... 206/494; 206/233

[58] Field of Search ..... 206/494, 233; 428/126, 128; 221/47, 48, 63

[56] References Cited

U.S. PATENT DOCUMENTS

| | | | |
|---|---|---|---|
| 180,984 | 8/1876 | Beebe/Canonge | 206/57 |
| 1,773,652 | 8/1930 | Traver | 206/57 |
| 1,860,812 | 5/1932 | Marshall | 206/494 |
| 1,980,059 | 11/1934 | Housen | 206/494 |
| 2,093,724 | 9/1937 | Horwitt | 206/494 |
| 2,115,673 | 4/1938 | Stompe | 206/57 |
| 2,118,473 | 5/1938 | Morris | 206/494 |
| 2,211,494 | 8/1940 | Christman | 206/494 |
| 2,316,796 | 4/1943 | Lichter | 206/57 |
| 2,529,853 | 11/1950 | Taggart | 206/57 |
| 2,621,788 | 12/1952 | Hitchcock | 206/57 |
| 4,151,787 | 5/1979 | Rohr et al. | 206/494 |
| 4,181,225 | 1/1980 | Spiegelberg | 221/63 |
| 4,192,420 | 3/1980 | Worrell, Sr. et al. | 206/205 |
| 4,210,247 | 7/1980 | Frye et al. | 206/494 |
| 4,460,088 | 7/1984 | Rugenstein et al. | 206/494 |
| 4,540,091 | 9/1985 | Habock | 206/57 |
| 4,817,790 | 4/1989 | Porat et al. | 206/494 |
| 4,982,845 | 1/1991 | Prascak et al. | 206/621 |
| 5,018,625 | 5/1991 | Focke et al. | 206/621 |
| 5,040,685 | 8/1991 | Focke et al. | 206/607 |
| 5,054,619 | 10/1991 | Muckenfuhs | 206/610 |
| 5,076,465 | 12/1991 | Lawson | 221/47 |

FOREIGN PATENT DOCUMENTS

| | | | |
|---|---|---|---|
| 467112 | 8/1950 | Canada | 206/57 |
| 0134130 | 3/1985 | European Pat. Off. | 206/459 |
| 0225865 | 11/1986 | European Pat. Off. . | |
| 0221168 | 10/1988 | European Pat. Off. | B65D 75/58 |
| 0247031 | 3/1990 | European Pat. Off. | B65D 33/16 |
| 2103361 | 4/1972 | France | B65D 83/00 |
| 7539076 | 4/1976 | Germany | B65D 85/16 |
| 3100286 | 1/1982 | Germany | 206/205 |
| 3324490 | 11/1984 | Germany | 206/57 |
| 3542999 | 8/1986 | Germany . | |
| 49-34478 | 9/1974 | Japan . | |
| 3307 | 2/1915 | United Kingdom . | |

*Primary Examiner*—David T. Fidei
*Attorney, Agent, or Firm*—Gregory E. Croft

[57] ABSTRACT

A tissue package containing a stack of tissues, commonly referred to as a pocket pack, has a resealable opening which is positioned over an exposed edge of the top tissue of the stack, thereby providing easier dispensing and opening of the tissues.

7 Claims, 4 Drawing Sheets

FACIAL TISSUE POCKET PACK

This is a continuation of application Ser. No. 08/005,712 filed on Jan. 19, 1993, now abandoned.

BACKGROUND OF THE INVENTION

Facial tissue is sold in a variety of packages, including a small plastic film package commonly referred to as a pocket pack. These packages are convenient for keeping in pockets, purses, automobile glove compartments, etc. where the larger tissue cartons would be inconvenient or impossible to keep. Many of the pocket pack packages include a resealable opening to protect the unused tissues after the package has been opened. The resealable opening is usually created by providing perforations in one of the package sidewalls to define a flap to cover the opening when the perforations are broken and attaching a resealable tape to the edge of the flap. An example of such a package is disclosed in U.S. Pat. No. 4,460,088 to Rugenstein et al. However, a common deficiency in such products is that it can be difficult to consistently withdraw only a single tissue. This arises because it is hard to distinguish one folded tissue from the others since the edges of all of the tissues within the package are exposed together. Hence the user oftentimes grabs more than one tissue. Also, the user must manipulate the folded tissue to locate and grasp an edge in order to unfold and open it.

Therefore there is a need for a tissue pocket pack product from which one tissue at a time can be easily withdrawn.

SUMMARY OF THE INVENTION

In general, the invention resides in a tissue package containing a stack of individually-folded tissues, each tissue being folded and assembled in the stack such that an edge of the uppermost tissue in the stack is exposed across the face of the folded tissue, said package having a resealable opening which overlays the exposed edge of the uppermost tissue in the stack, wherein the uppermost tissue can be removed from the package by opening the resealable opening, grasping the exposed edge of the tissue, and pulling the tissue out through the opening. Preferably, the exposed edge of the folded tissue is about midway between the opposite sides of the folded tissue and the resealable opening is positioned so that the exposed edge appears in about the middle of the opening for easy access.

The invention will be described in greater detail by reference to the Drawing.

DETAILED DESCRIPTION OF THE INVENTION

Figure 1:
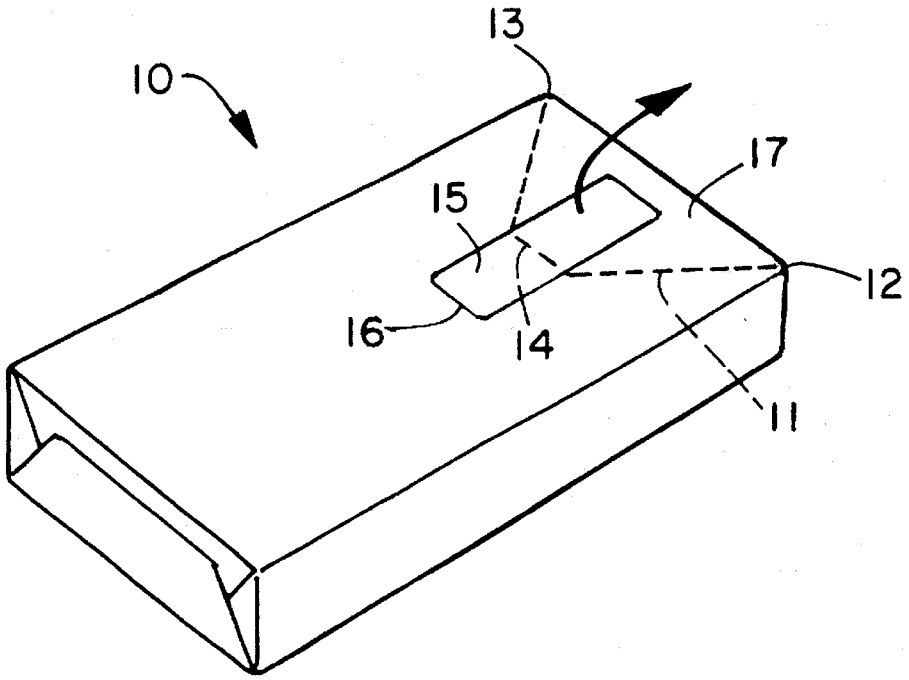
FIG. 1 (PRIOR ART)
FIG. 1 is a perspective view of a prior art facial tissue pocket pack containing a stack of individually folded tissues.

Referring to FIG. 1, shown is a perspective view of a prior art facial tissue package 10 having a resealable opening. As is common for this type of package, the package material is a thin flexible plastic film which has been folded and sealed around a small stack of folded tissues. The resealable opening has the shape of a trapezoid and is partially defined by perforations 11 in the plastic film which emanate from the corners 12 and 13 of the package and converge toward the short side 14 of the opening. A tab 15 backed with a releasable adhesive is adhered to the face of the package on both sides of the perforation line defining the short side 14 of the opening. One end 16 of the tab does not have adhesive to make it easier to grasp. In use, the user grasps the end 16 of the tab and pulls in the direction of the arrow to break the perforations and pull back the opening flap 17, thereby exposing the tissues inside.

Figure 2:
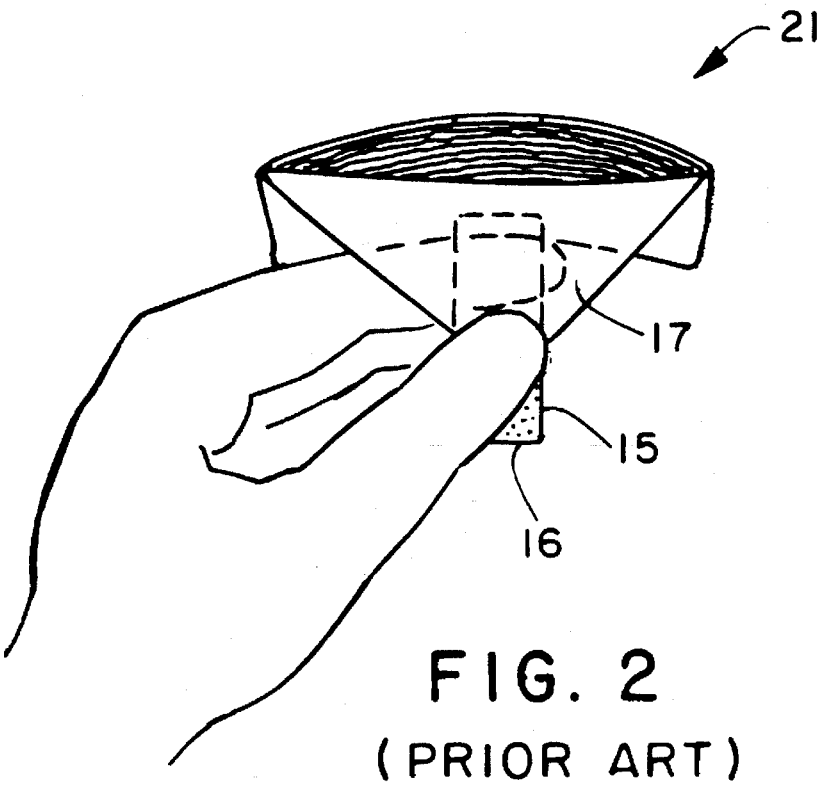
FIG. 2 (PRIOR ART)
FIG. 2 is an end view of the package of FIG. 1 after the resealable opening has been fully opened, illustrating the many exposed tissue end folds presented to the user when attempting to withdraw a single tissue from the package.

FIG. 2 is an end view of the package of FIG. 1 after the opening flap has been completely pulled back. As shown, the user may bend the package by pressing the back side of the package upwardly while pulling the flap downwardly to more fully expose the end folds 21 of the tissues within the stack. Typically, the number of folded tissues within the stack is about ten or fifteen, each tissue having four end folds exposed. Therefore, the user is faced with from about forty to sixty end folds and must try to grasp only those of the uppermost tissue in the stack to avoid removing more than one tissue. Difficulty of tissue removal has proven to be a major complaint among users of this type of package.

Figure 3:
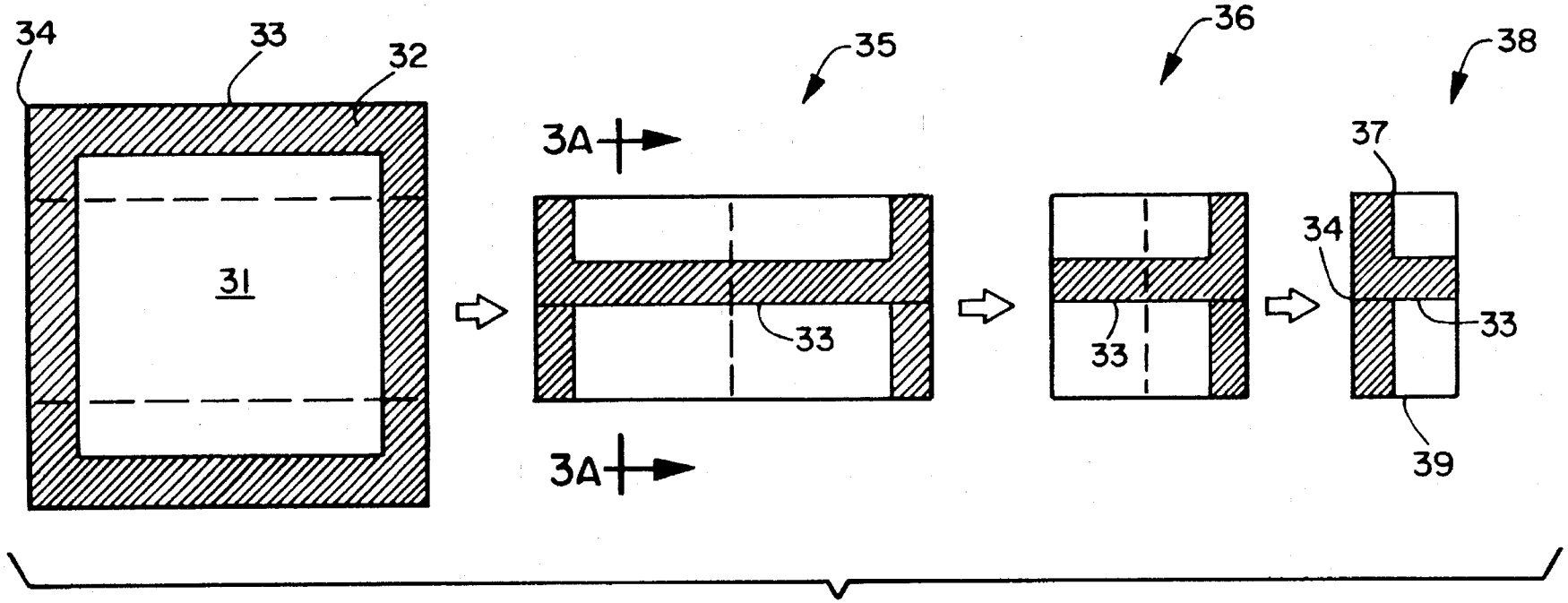
FIG. 3 is a series of plan views of an individual facial tissue in all of its sequential folding configurations as it is folded into a size and shape preferable for the pocket pack package.

FIG. 3 illustrates a preferred manner of folding individual tissues for use in a pocket pack package, including the package of this invention as well as the prior art package of FIGS. 1 and 2. Shown are four folding stages, beginning with a full-sized single sheet of tissue 31 measuring about 8.75 inches×8.5 inches, which has been edge embossed with a decorative pattern 32. For reference, an edge 33 and a corner 34 of the tissue are identified to follow the folding sequence. In all stages, dashed lines indicate where the tissue will be folded next to reach the following stage. In essence, the tissue sheet is z-folded, folded in half with the fold line perpendicular to the z-folds, and again folded in half with the fold line perpendicular to the z-folds. As shown in the first figure, the z-fold lines are parallel to the longer dimension of the tissue sheet.

Figure 3A:
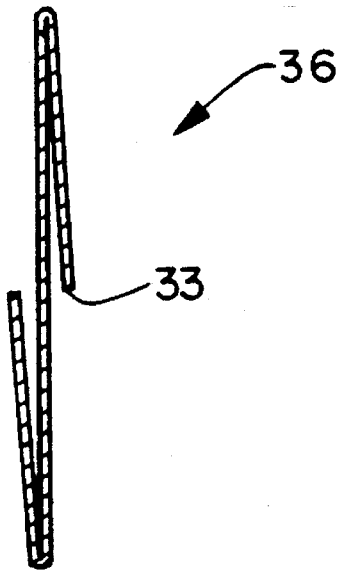
FIG. 3*a* is an end fold of the Z-fold tissue.

The folded configuration illustrated in the second figure of the folding sequence is referred to as a "z-folded" configuration 35, in which opposite edges of the tissue are folded to place both edges at the centerline of the tissue sheet. This configuration is further illustrated in FIG. 3A, which is an end view of the z-folded tissue 35. As previously mentioned, the dashed line indicates the next fold line, which is perpendicular to the z-fold lines. As viewed on the page, the left side of the z-folded tissue is folded underneath the right side to fold the tissue in half to give the configuration 36 shown in the third figure of the sequence. Then, as before, the tissue is again folded in half where indicated by the dashed line, this time with the right side being folded over the left side to give the final folded configuration 38. As shown, the edge 33 of the tissue is exposed on the face of the folded tissue. Specifically, it is midway between and parallel to opposite sides 37 and 39 of the folded tissue.

Figure 4:
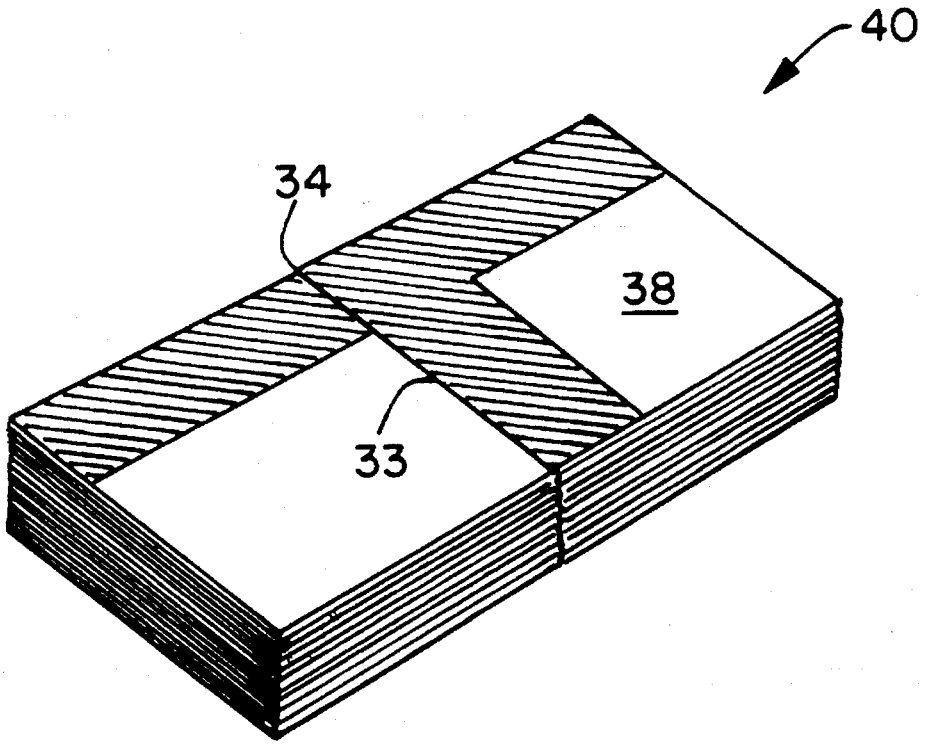
FIG. 4 is a stack of the individually folded facial tissues of FIG. 3.

FIG. 4 is a perspective view of a stack 40 of individually folded tissues of the kind shown in FIG. 3. All of the tissues in the stack are preferably oriented the same as the tissue on the top of the stack. However, using the folding sequence described above, the opposite side of the folded tissue 38 also has an exposed edge 33 and could also serve as the outwardly facing side of the folded tissue.

Figure 5:
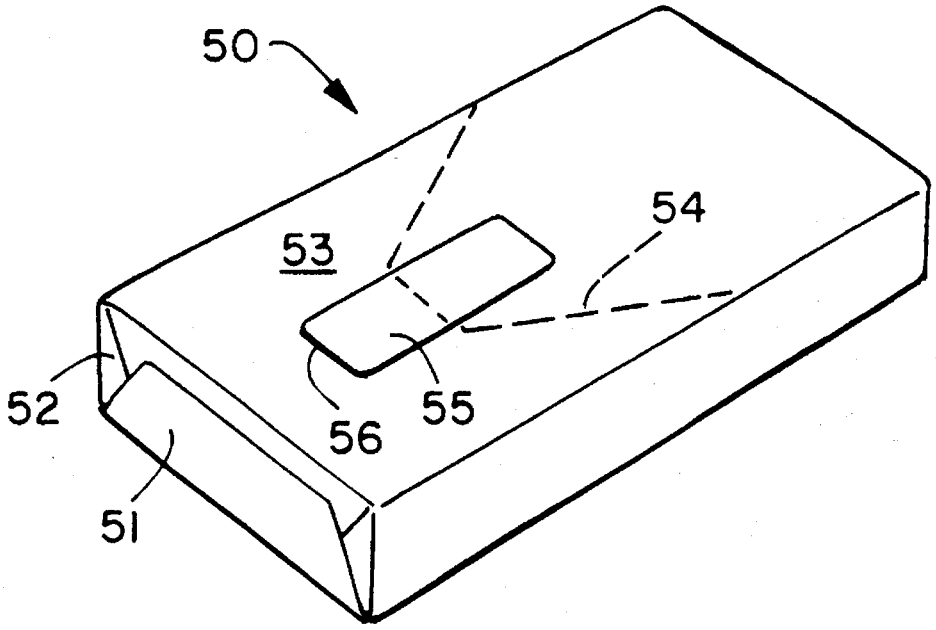
FIG. 5 is a perspective view of a preferred tissue package of this invention.

FIG. 5 is a perspective view of a preferred embodiment 50 of the tissue package of this invention. The package preferably contains from about ten to about fifteen individually-folded regular size facial tissues. The package material is a flexible polyethylene film which has been appropriately perforated and wrapped around a stack of folded tissues with the overlapping edges and flaps thereafter heat-sealed. Shown in FIG. 5 are sealed overlapping end flaps 51 and 52, perforated dispensing sidewall 53, perforations 54 defining the shape of the flap and partly defining the dispensing opening, and the releasable adhesive-backed pull tab 55. The adhesive on the back of the pull tab covers all but the leading edge 56 of the back of the pull tab in order to make the leading edge readily graspable with one's fingers. As shown, the perforations extend at an angle from opposite sides of the dispensing sidewall and converge midway between the opposite sides of the dispensing sidewall.

Figure 6:
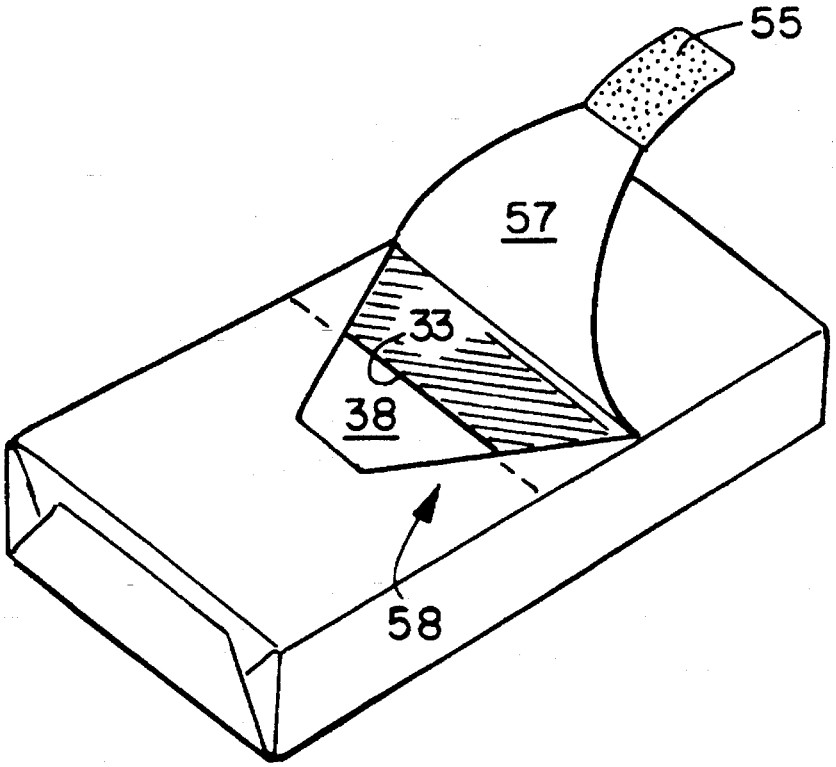
FIG. 6 is a perspective view of the package of FIG. 5 with the resealable opening flap fully opened to expose the uppermost tissue of the stack of tissues within the package.

FIG. 6 is a perspective view of the package of FIG. 5 with the perforations broken and the resulting flap 57 pulled back to form the dispensing opening 58 defined by the broken perforations and the fold of the flap. The shape of the opening is trapezoidal. The face of the uppermost tissue 38 of the stack of folded tissues within the package is exposed, including the edge 33 of the folded tissue. In order to remove the uppermost tissue from the package, the user merely inserts a finger underneath the exposed edge 33 of the tissue and grasps the edge and pulls the tissue out of the package through the opening. In so doing, pulling the tissue out through the opening while grasping an edge causes the tissue to open (unfold), which is an added convenience for the user.

It is essential that the location of the opening overlay an exposed edge of the folded tissue. Preferably, the exposed edge of the folded tissue is about in the middle of the face of the folded tissue and accordingly the opening is also about in the middle of the dispensing sidewall of the package. However, by using a different folding pattern or sequence, it is possible to create a folded tissue having an exposed edge positioned above or below the location illustrated. Such a situation is within the scope of this invention provided the dispensing opening overlays the exposed edge to enable the user to grasp it.

The shape of the opening is not critical, although the size of the opening must be large enough to allow removal of the tissues without tearing them, yet small enough to contain the tissues within the pack when the flap is open. In a preferred embodiment as illustrated in FIG. 6, the distance between the parallel sides of the trapezoidal opening 58 is about 40 millimeters. A trapezoidal shape with a relatively narrow end is preferred because a rectangular pull tab can cover all or most of the narrow end of the flap and thereby eliminate or substantially eliminate any exposed corners which might otherwise detract from the appearance of the package after the package has been in use for some time. The perforations can extend to the sides of the dispensing sidewall as shown, or they can fall short, or even wrap around the edges of the package, provided the opening is of a size which functions properly. The perforations can also follow a curvilinear line, rather than a straight line, to form a wide variety of flap and dispensing opening shapes.

It will be appreciated that the foregoing drawing, given for purposes of illustration, is not to be construed as limiting the scope of this invention, which is defined by the following claims and all equivalents thereto.

I claim:

1. A tissue package containing a stack of individually-folded tissues, each tissue being z-folded, then folded in half with the fold line perpendicular to the z-fold lines, and then folded in half again with the fold line perpendicular to the z-fold lines such that an edge of the uppermost tissue of the stack is exposed across the face of the folded tissue, said package having a dispensing sidewall containing a resealable opening which overlays the exposed edge of the uppermost tissue of the stack, wherein the uppermost tissue can be removed from the package by opening the resealable opening, grasping the exposed edge of the tissue, and pulling the tissue out through the opening.

2. The tissue stack of claim 1 wherein the number of folded tissues in the stack is about 10.

3. The tissues package of claim 1 wherein the number of folded tissues within the stack is about 15.

4. The tissue package of claim 1 wherein the shape of the dispensing opening is determined by folding back a flap in the dispensing sidewall, the shape of the flap being defined by perforations in the dispensing sidewall, said perforations extending at an angle from opposite sides of the dispensing sidewall and converging midway between said opposite sides of the sidewall.

5. The tissue package of claim 4 wherein the opening is about centered within the dispensing sidewall of the package.

6. The tissue package of claim 5 wherein the dispensing opening is trapezoidal in shape.

7. A tissue package containing a stack of from about 10 to about 15 individually-folded tissues, each tissue having been z-folded, then folded in half with the fold line perpendicular to the z-fold lines, and then folded in half again with the fold line perpendicular to the z-fold lines, wherein an edge of each tissue is exposed across the face of the folded tissue, said package having a dispensing sidewall containing a resealable, trapezoidal-shaped opening centered in the dispensing sidewall and which overlays the exposed edge of the uppermost tissue in the stack, said trapezoidal opening formed by folding back a flap in the dispensing sidewall, the shape of which is defined by perforations in the dispensing sidewall which extend at an angle from opposite sides of the dispensing sidewall and converge midway between said opposite sides of the sidewall, wherein the uppermost tissue of the stack can be removed from the package by opening the resealable opening, grasping the exposed edge of the tissue, and pulling the tissue out through the opening.

* * * * *